United States Patent [19]

Tsuruda

[11] Patent Number: 4,805,492

[45] Date of Patent: Feb. 21, 1989

[54] METHOD FOR CONTROLLING A SHAPE OF A PLATE

[75] Inventor: Makoto Tsuruda, Hyogo, Japan

[73] Assignee: Mitsubishi Denki Kabushiki Kaisha, Tokyo, Japan

[21] Appl. No.: 81,751

[22] Filed: Aug. 5, 1987

[30] Foreign Application Priority Data

Sep. 24, 1986 [JP] Japan ..... 61-225694

[51] Int. Cl.[4] ..... B21B 1/22; B21B 37/00

[52] U.S. Cl. ..... 72/8; 72/11; 72/16; 72/20; 72/234; 72/243; 72/245; 364/472

[58] Field of Search ..... 72/16, 8–12, 72/17, 20, 243, 245, 234; 364/472

[56] References Cited

U.S. PATENT DOCUMENTS

| | | | |
|---|---|---|---|
| 4,633,692 | 1/1987 | Watanabe | 72/16 X |
| 4,633,693 | 1/1987 | Tahara et al. | 72/16 X |
| 4,683,744 | 8/1987 | Ginzburg et al. | 72/243 |
| 4,711,109 | 12/1987 | Rohde et al. | 72/8 |
| 4,715,209 | 12/1987 | Oshima | 72/20 X |

FOREIGN PATENT DOCUMENTS

| | | |
|---|---|---|
| 52-15253 | 4/1977 | Japan . |
| 59-47006 | 3/1984 | Japan . |

*Primary Examiner*—Robert L. Spruill
*Assistant Examiner*—Steven B. Katz
*Attorney, Agent, or Firm*—Bernard, Rothwell & Brown

[57] ABSTRACT

In rolling mill equipment provided with a roll bending mechanism for removing an unacceptable shape of a plate in width direction of the plate and a crown of a plate in the form of an uneven configuration at both edges with respect to a center line of the plate, there is disclosed a method for controlling a shape of a plate in an attempt to avoid producing abnormal shape in said width direction. The method comprises sequentially finding preset values of a roll bending force from preceding to succeeding stage of feed so as to fulfill both restriction of plate shape and restriction of roll beinding force by a set of stands provided in plural at suitable places in a direction of feeding plates, each strand comprising a pair of work rolls, a pair of backup rolls, a roll bending force setting unit, using the thus obtained roll bending force, the maximum and minimum crowns at the final stand and an target crown determined by a thickness, tension and the like of a plate to be rolled to decide a preset value of the roll bending force in each stand, whereby providing a control so that the width shape caused by rolling is improved in profile regularity.

6 Claims, 2 Drawing Sheets

METHOD FOR CONTROLLING A SHAPE OF A PLATE

BACKGROUND OF THE INVENTION

1. Field of the Invention

This invention relates to a method for controlling a shape of a plate, which method controls a rolling shape of a plate by a rolling mill having a roll bending mechanism.

2. Description of the Prior Art

Generally, in the rolling mill equipment for rolling a steel plate, for example, such as a thick plate, various attempts have been made in order to finish steel plates sequentially delivered with a uniform thickness or a good surface precision in both longitudinal and width directions. Among them, for the control of a longitudinal shape of a plate, rolling control is employed which is based on a wired logic incorporating a feedback control, a sequence control or the like in a rolling line, and an Automatic Gage Control (AGC) device or the like relying on a reference thickness of a plate has been used. However, the control of a widthwise plate thickness of a plate cannot be carried out by the AGC device. In view of this, a roll bending method is used as a method for controlling a width thickness of a plate. Accordingly, a roll bending apparatus applied to this method intentionally bends a roll externally by means of hydraulic pressure or the like to thereby effect accurate control when the roll is put in a stand.

FIGS. 1A and 1B are a perspective view and a fragmentary sectional view, respectively, showing a shape or form of a plate rolled by a conventional rolling mill. In these figures, reference numeral 1 designates a plate. Where the coefficient of extension of the plate 1 is not even in the width direction of the plate, undulations 2 are produced at the edges thereof. When the plate is undulated upwardly through m with respect to a fixed length l of a flat portion 3, the undulation extends as indicated by l', and a steepness λ of said undulation is expressed by m/l. The following equation is obtained.

$$(l'-l)/l=2.5\lambda^2$$

FIG. 2 is a conceptual view of a plate crown. A work roll 4 in contact with the plate 1 and a backup roll 5 adjacent thereto are subjected to reaction of the plate 1 to produce a bending phenomenon, thus producing crowns as indicated by flexed curves 4*a* and 5*a*.

In FIG. 2, the hatched portion a indicates an approximate value of a contact elastic strain amount of both the rolls 4 and 5, and the hatched portion b indicates a contact elastic strain amount of the work roll.

On the other hand, a shape control method for presetting a roll bending force in order to obtain an intended plate shape is disclosed, for example, in Japanese Patent Publication No. 15253/1977 publication. According to this publication, a calculation formula of a roll bending force for making constant the coefficient of extension widthwise for determining a plate shape is theoretically studied to provide a relative formula, by which the bending force is determined.

In the conventional method for controlling a shape of a plate, the roll bending force for making constant the coefficient of extension widthwise is derived from the calculation formula. However, it is not assured that a value obtained therefrom positively falls into a hardware of a rolling mill in terms of restriction of the hardware. Therefore, a problem occurs that a pattern is not always realizable.

In addition, even at present, iron manufacturers are working hard to elucidate the calculation formula but cannot obtain it easily.

SUMMARY OF THE INVENTION

It is an object of this invention to provide a method for controlling a shape of a plate in which a preset value of a roll bending force which can be realized is employed to obtain a proper plate crown and a good plate shape.

For achieving the aforesaid object, a method for controlling a shape of a plate according to this invention comprises, in order to obtain a target crown and a shape on the basis of an estimated rolling force, a thickness, a tension and the like given by a schedule calculation, a first step for obtaining a roll bending force of each stand to form maximum and minimum crowns in a final stand obtained so as to fulfill the roll bending force and the restriction of shape between stands, and a target crown using the roll bending force of each stand corresponding to the respective crowns, and a second step for obtaining a corrected amount from the roll bending force obtained by the first step so as to make zero the dissatisfaction of the final stand shape by the obtained roll bending force and the shape between stands to provide a preset value of the final roll bending force, from which steps, a preset value of a roll bending force of each stand is obtained.

DETAILED DESCRIPTION OF THE PREFERRED EMBODIMENTS

Preferred embodiments of a method for controlling a shape of a plate according to this invention will be described hereinafter with reference to the accompanying drawings.

Figure 1A:
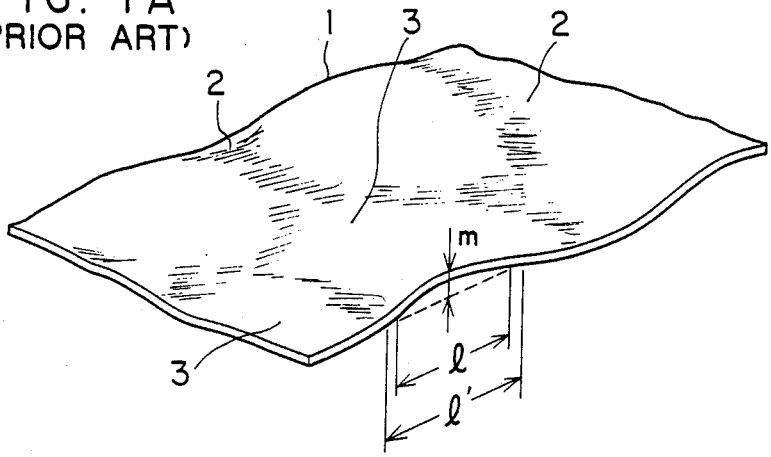
FIG. 1A (PRIOR ART)
FIGS. 1A and 1B are a schematic perspective view and a fragmentary enlarged sectional view, respectively, showing a shape of a plate rolled by a conventional rolling mill.
Figure 1B:
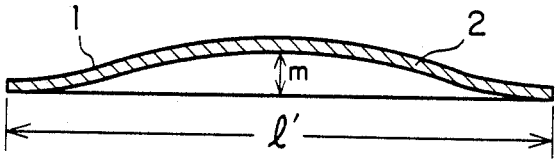
FIG. 1B (PRIOR ART)
Figure 2:
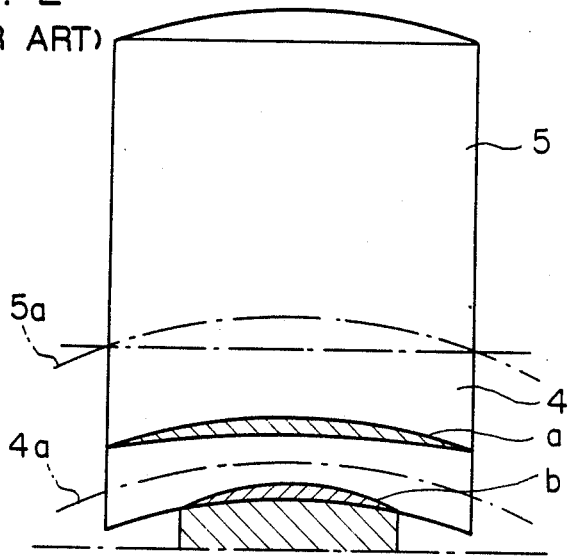
FIG. 2 (PRIOR ART)
FIG. 2 is a conceptual view showing a crown state of a work roll and a backup roll in a conventional rolling mill.
Figure 3:
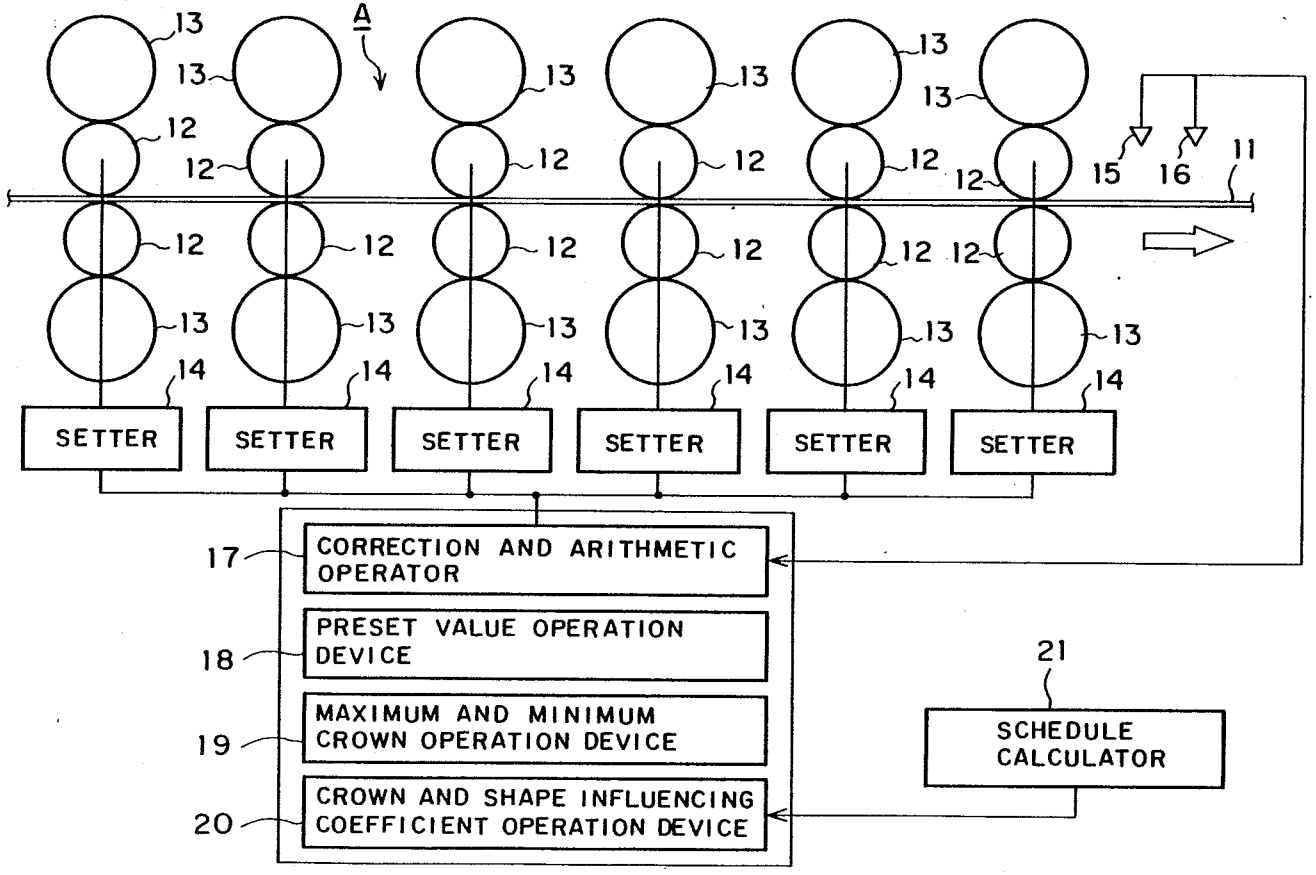
FIG. 3 is a block diagram showing a control apparatus applied to one embodiment of a method for controlling a shape of a plate according to this invention.

FIG. 3 is a connection diagram showing a shape control system applied to one embodiment of this invention.

In FIG. 3, A designates a quadruple rolling mill having a roll bending device between work rolls; 11, a plate material; 12, a work roll in direct pressure contact with the plate 11; 13, a backup roll in contact with and to strengthen the work roll 12; 14, a roll bending force setting device; 15, a shape detector for the plate 11; 16, a crown detector; 17, a correction and arithmetic operator; 18, a preset value operation device; 19, a maximum and minimum crown operation device; 20, a crown and shape influencing coefficient operation device; and 21, a schedule calculating device for thickness, rolling force, tension, rolling speed, and the like. The shape detector 15 and the crown detector 16 are disposed at the outlet of the final stand in a position where they are capable of detecting profile irregularity of both the upper and lower surfaces of the plate being rolled.

The principle of operation and then the operation of embodiments will be described hereinafter.

First, the plate crown and the shape, which are the basic matter, are as follows:

$$C_i = \alpha_P^i \cdot P_i + \alpha_F^i \cdot F_i + \alpha_{CW}^i \cdot R_{CWi} + \alpha_{CB}^i \cdot R_{CBi} + \alpha_C^i \cdot C_{i-1} \quad (1)$$

$$\epsilon_i = \xi_i \left( \frac{C_i}{h_i} - \frac{C_{i-1}}{h_{i-1}} = \zeta_i \, \epsilon_{i-1} \right) \quad (2)$$

Equation (1) is related to the plate crown, and equation (2) to the plate shape. In the equation (1), $\alpha_P^i$, $\alpha_F^i$, $\alpha_{CW}^i$, $\alpha_{CB}^i$, $\alpha_C^i$ refer to the crown influencing coefficient by the rolling load ($P_i$), roll bending force ($F_i$), work roll crown ($R_{CWi}$) and backup roll crown ($R_{CBi}$), entry crown ($C_{i-1}$), respectively. In the equation (2), h refers to a thickness of a plate and $\xi$, $\zeta$ refer to the coefficients of shape.

These influencing coefficients are obtained, for example, by an equation related to a bend of a roll.

$$\frac{d^4y}{dx^4} = \frac{P_F}{EI} + \frac{3}{4GA} \frac{d^2P(x)}{dx^2} \quad (3)$$

x: the coordinate in an axial direction of the roll
y: the amount of bend of the roll axis
E: the longitudinal elastic coefficient of the roll
I: the secondary moment of the section of the roll
$P_F$: the load per unit length widthwise
G: the lateral coefficient of the roll
A: the sectional area of the roll
P(x): the distribution of the rolling load in the axial direction of the roll The equation (3) may be solved by giving the load distribution P(x) and boundary conditions.

In the rolling, since the rolls are expanded due to heat to affect the crown shape, it is also necessary to obtain a thermal crown by the following formula to take $R_{CW}$ and $R_{CB}$ into consideration.

$$u_r = \frac{2\beta(1+\sigma)}{R} \int_O^R T(r) r dr \quad (4)$$

where, $\beta$: the coefficient of linear expansion
$\sigma$: the Poison's ratio
r: the radial distance
T(r): the radial temperature distribution
$u_r$: the radial displacement of the roll The T(r) is obtained by giving the boundary conditions in the surface of a column or the like, in the following basic equation regarding a column.

$$\frac{\partial T}{\partial t} = \left( \frac{\partial^2 T}{\partial r^2} + \frac{1}{r} \frac{\partial T}{\partial r} \right) \quad (5)$$

In this way, $R_{CWi}$, $R_{CBi}$, $P_i$ in the equations (1) and (2) are known, and $C_i$ and $\epsilon_i$ are obtained by giving the roll bending force $F_i$.

Next, the crown control range in the final stand fulfilling the restriction of shape between stands the restriction of the roll bending force is obtained. That is, in obtaining the maximum crown, the minimum value $F_i^L$ which restricts the roll bending force is put in the equation (1) to obtain the shape $\epsilon_i$ from the equation (2). If at that time, the shape restriction, $\epsilon_i^L \leqq \epsilon_i \leqq \epsilon_i^U$ is not fulfilled, the $F_i$ is conversely obtained by putting $C_i^*$ solved by replacing the left side of the equation (2) with $\epsilon_i^L$ or $\epsilon_i^U$. This procedure is repeated down to the final stand to obtain the maximum crown $C_N^{max}$.

Conversely, when the maximum value $F_i$ of the roll bending force is used to carry out the calculation in a manner as described above, the minimum crown $C_N^{min}$ is obtained.

Thus, the roll bending forces $F_i^{min}$ and $F_i^{max}$ corresponding to $C_N^{max}$ and $C_N^{min}$ are obtained.

The target shape at the final stand is normally 0, and so, $\epsilon_N^L = \epsilon_N^U = 0$ is given.

When the crown control range is obtained in this manner and the relation of $C_i^{min} \leqq C_{ref} \leqq C_i^{max}$ is established, there is a combination of roll bending forces for the target crown and target shape. Thus, the roll bending force in each stand is obtained by $$\Delta C = C_{ref} - C_N^{min} \quad (6)$$

Let $F_i^C$ represent the roll bending force for $C_N = C_{ref}$ and $\Delta F_i = F_i^C - F_i^{max} = a(F_i^{max} - F_i^{min})$ the difference with $F_{imax}$, the force is obtained by solving the equation (1) by the following equation.

$$\begin{aligned} \Delta C &= \alpha_C^N \cdot \Delta C_{N-1} + \alpha_F^N \cdot \Delta F_N \\ &= \alpha_F^N \Delta F_N + \alpha_C^N (\alpha_{N-1}^C \cdot \Delta C_{N-2} + \alpha_{N-1}^F \cdot \Delta F_{N-1}) \\ &= \sum_{j=1}^{N-1} \left\{ \left( \prod_{i=N-1}^{j} \alpha_i^C \right) \alpha_j^F \cdot \Delta F_j \right\} + \alpha_N^F \cdot \Delta F_N \end{aligned} \quad (7)$$

$$\prod_{i=j}^{k} \alpha_i = \alpha_j \cdot \alpha_{j+1} \cdot \alpha_{j+2} \cdot \alpha_{k-2} \cdot \alpha_{k-1} \cdot \alpha_k (j \leqq K) \quad (8)$$

$$\Delta C = a \left[ \sum_{j=1}^{N-1} \left\{ \left( \prod_{i=N-1}^{j} \alpha_i^C \right) \alpha_j^F (F_i^{max} - F_i^{min}) \right\} + \alpha_N^F (F_N^{max} - F_N^{min}) \right] \quad (7)'$$

Then,

-continued $$a = \frac{\Delta C}{\left[\sum_{j=1}^{N-1}\left\{\left(\prod_{i=N-1}^{j} \alpha_i^C\right)\alpha_j^F (F_i^{max} - F_i^{min})\right\} + \alpha_N^F (F_N^{max} - F_N^{min})\right]} \quad (9)$$

Accordingly, the roll bending force of each stand for $C_N = C_{ref}$ is given by $$F_i^C = F_i^{max} + a(F_i^{max} - F_i^{min}) \quad (10)$$

Apparently, the relationship of $-1 \leqq a \leqq 0$ is apparent, and $F_i^C$ fulfills the restriction of bending force without fail.

However, the relationship of $\epsilon_N = \epsilon_{ref}$ is not always established by $F_i^C$. If the following conditions are fulfilled with $\epsilon_N = \epsilon_N^C$ by $F_i^C$, $\epsilon_N = O$, $C_N = C_{ref}$ can be obtained.

$$\begin{cases} \epsilon_{ref} - \epsilon_N = \sum_{i=1}^{N} b_i^\epsilon \cdot \Delta F_i^\epsilon \\ O = \sum_{i=1}^{N} b_i^C \cdot \Delta F_i^\epsilon \end{cases} \quad (11)$$

Here, $b_i^\epsilon$ and $b_i^C$ are obtained by solving the equations (1) and (2) in a manner similar to the equation (7). $\Delta F_i^\epsilon$ is the corrected bending force from $F_i^C$, and $\epsilon_N$ is the plate shape of the final stand when rolled at $F_i^C$.

There are N unknowns and two equations in the equation (11), and therefore the equation may be solved by adding some (N−2) conditions.

If the following relationship is fulfilled with $\Delta\epsilon_i^C$ being unacceptable shape of each stand at $F_i^C$, ideal rolling becomes possible. The bending amount so as to cancel this $\Delta\epsilon_i^C$ may well be carried out at $\Delta F_i^\epsilon$. When the $\Delta F_i^\epsilon$ is used, the change $\Delta\epsilon_i$ of shape in each stand relative to the time of $F_i^C$ is given by $$\Delta\epsilon_i = \xi_i \{\alpha_i^F \cdot \Delta F_i^\epsilon + (\alpha_i^C + \zeta_i \cdot \xi_{i-1} - 1)\, \alpha_{i-1}^F \cdot \Delta F_{i-1}^\epsilon\} + f(\Delta F_{i-2}, \ldots, \Delta F_1) \quad (12)$$

$$\simeq \xi_i \{\alpha_i^F \cdot \Delta F_i + (\alpha_i^C + \zeta_i \cdot \xi_{i-1} - 1)\, \alpha_{i-1}^F \cdot \Delta F_{i-1}\}$$

$$\therefore -\Delta\epsilon_i^C \cdot G_i = \xi_i \{\alpha_i^F \cdot \Delta F_i^\epsilon + (\alpha_i^C + \zeta_i \cdot \xi_{i-1} - 1)\, \alpha_{i-1}^F \cdot \Delta F_{i-1}^\epsilon$$

From equations (11) and (12), the following is obtained.

$$\begin{pmatrix} \Delta F_1^\epsilon \\ \Delta F_2^\epsilon \\ \vdots \\ \Delta F_{N-1}^\epsilon \\ \Delta F_N^\epsilon \end{pmatrix} = \quad (13)$$

-continued $$\begin{pmatrix} b_1^\epsilon & b_2^\epsilon & b_3^\epsilon & \cdots & b_{N-1}^\epsilon & b_N^\epsilon \\ \alpha_1^F(\alpha_2^C + \zeta_2 \cdot \xi_1 - 1) & \alpha_2^F & 0 & \cdots & \cdots & 0 \\ 0 & \alpha_2^F(\alpha_3^C + \zeta_3 \cdot \xi_2 - 1)\alpha_3^F & \cdot & \cdots & \cdots & \cdot \\ \vdots & \vdots & \vdots & 0 & \vdots & \vdots \\ 0 & 0 & 0 & \cdots & \alpha_{N-2}^F(\alpha_{N-1}^C + \zeta_{N-1} \cdot \xi_{N-2} - 1) & 0 \\ b_1^C & b_2^C & \cdots & \cdots & b_{N-1}^C & \alpha_{N-1}^F \\ & & & & & b_N^C \end{pmatrix}^{-1} \times \begin{pmatrix} \epsilon_{ref} - \epsilon_N \\ -G_2\Delta\epsilon_2^C/\xi_2 \\ -G_3\Delta\epsilon_3^C/\xi_3 \\ \vdots \\ -G_{N-1}\,\Delta\epsilon_{N-1}^C/\xi_{N-1} \\ 0 \end{pmatrix}$$

Here, $-1$ is a reverse matrix. If $G_2$ to $G_{N-1}$ are made to be the reverse deviation with $G_i = 0$, the unacceptable value of shape produced at $F_i^C$ results. That is, this is a matter to what extent $\Delta\epsilon_i^C$ produced by $G_i$ at $F_i^C$ is corrected, and if all the $G_i$ is made to 1, all the unacceptable shape between stands can be made to 0.

However, the closer the $G_i$ to 1, the greater the corrected value of $\Delta F_i$, and $(F_i^C + F_i^\epsilon)$ possibly overflows the restriction of the bending force, which can be said to be a control means. Even in the case of $G_i = 0$, it possibly overflows the restriction of the bending force in the preceding stand. The inventor has confirmed that the restriction of the bending force can be satisfied by varying the conditions to assume $\Delta F_i = \Delta F_{i-1}$ sequentially from the preceding stand.

The preset value $F_i^S$ for the bending force to provide a target crown and a plate shape as described is obtained by $$F_i^S = F_i^{max} + \alpha(F_i^{max} - F_i^{min}) + \Delta F_i^\epsilon \quad (14)$$

The equation (13) can be employed for the feedback control. $\epsilon_N$ is replaced by the output of the shape detector 15 and 0 on the Nth line of a matrix of n-line one-row on the right side of the equation (13) replaced by $(C_{ref} - C_N)$, and $C_N$ is put as the output of the crown detector 16 to solve the equation. And the feedback correction amount $\Delta F_i$ may be controlled.

Next, the shape control of the above-described embodiment will be described by reference to FIG. 3.

First, the schedule calculator 21 carries out the schedule calculation of thickness, rolling force, tension, rolling speed and the like, on the basis of which information the influencing coefficients of the crown and plate shape are arithmetically operated by the influencing coefficient arithmetic operator 20. This coefficient is used, and the maximum and minimum crowns are found by the maximum and minimum crown arithmetic operator 19. The preset value of the work roll bending force which forms a nucleus of this invention is arithmetically operated by the preset value arithmetic operator 18. This preset value is outputted to the roll bending force setter device 14 to control the backup roll 13.

This control operation is accomplished at the time of presetting. When the plate 11 is fed, the plate shape and the crown actual value are fed to the correction arithmetic operator 17 by the shape detector 15 and the crown detector 16 to arithmetically operate at error relative to the target crown shape, whereby the roll bending force setter device 14 is controlled.

As described above, according to the present invention, the realizable roll bending force preset value is obtained to simultaneously fulfill the crown and shape of a plate, thus obtaining a plate product of good quality, as well as an advantage that an unacceptable shape and crown produced during feeding may be corrected.

What is claimed is:

1. A method for controlling a rolling shape of a plate in a rolling system comprising a rolling mill including a plurality of stands for rolling plates continuously fed lengthwise into a predetermined plate thickness, and a roll bending mechanism for controlling a rolling shape of the plate so that the rolling operation of said rolling mill is carried out without producing an unacceptable shape including a crown in which a center line side is convex or concave with respect to opposite edge sides over the width of a thickness of said plate, the method comprising;

a first step for providing a roll bending force in each stand in order to obtain a target crown on the basis of estimated control values including an estimated thickness, an estimated tension of said plate to be rolled and an estimated pressing force of said rolling mill, said first step including calculating a crown range between maximum and minimum crown in a final stand, employing the calculated crown range to preset a roll bending force at each stand for obtaining at said final stand a crown within said range and for restricting the change of shape of the plate between successive stands, and a second step for providing a correction amount with respect to the roll bending force in said first step to establish a preset value of the final roll bending force in each stand so as to provide a target shape of plate in said final stand and between said stands.

2. A method according to claim 1, using in said first step a schedule calculating device for calculating a thickness and tension of said plate, and a rolling force and a rolling speed of said rolling mill along a flow of a rolling line, and using a crown shape influencing coefficient operating device for arithmetically operating an influencing coefficient related to said plate, to find a roll bending force in each stand.

3. A method according to claim 1, using in said second step a feedback control in which said correction amount is determined on the basis of a shape-and-crown-detected-values of said plate at the outlet of said final stand, and modifying the preset value of the final roll bending force by said correction amount.

4. A method according to claim 3, using in said second step a correction and arithmetical operating device for receiving said shape-and-crown-detected-values of said plate at the outlet of said final stand and modifying the preset value of said final roll bending force by said correction amount.

5. A method according to claim 4, using in said second step a plate shape detector and a plate crown detector positioned at the outlet of said final stand for detecting a profile irregularity of both upper and lower surfaces of said plate to provide said shape-and-crown detected values of said plate at the outlet of said final stand for establishing said correction amount.

6. A method according to claim 1, and including continuously feeding the plate to be rolled between a pair of work rolls engaged by a pair of backup rolls for urging said work rolls from both top and bottom, and using a roll bending force setting unit for subjecting said work rolls to roll bending control in each stand according to said preset value established in said second step.

* * * * *

UNITED STATES PATENT AND TRADEMARK OFFICE

CERTIFICATE OF CORRECTION

PATENT NO. : 4,805,492

DATED : February 21, 1989

INVENTOR(S) : MAKOTO TSURUDA

It is certified that error appears in the above-identified patent and that said Letters Patent is hereby corrected as shown below:

Front Page, Col. 2, [57], line 12, "beinding" should be --bending--;
Front Page, Col. 2, [57], line 14, "strand" should be --stand--;
Front page, Col. 2, [57], line 18, "an" should be --a--.
Col. 1, line 39, "1" should be --ℓ--;
Col. 1, line 40, "1" should be --ℓ--;
Col. 1, line 41, "1" should be --ℓ--;
Col. 1, line 51, "of both" should be --between--;
Col. 3, line 10, "=" (second occurrence" should be -- + --;
Col. 3, line 45, "rdr" should be --r dr--.
Col. 5, line 55, at the end of the equation insert --}--.

Signed and Sealed this

Fifth Day of February, 1991

*Attest:*

*Attesting Officer*

HARRY F. MANBECK, JR.

*Commissioner of Patents and Trademarks*